US005637057A

United States Patent [19]

Collura

[11] Patent Number: 5,637,057

[45] Date of Patent: Jun. 10, 1997

[54] TIRE TRAMPOLINE APPARATUS

[76] Inventor: Frank Collura, 2926 W. Jean St., Tampa, Fla. 33614-4237

[21] Appl. No.: 374,337

[22] Filed: Jan. 18, 1995

[51] Int. Cl.[6] ..... A63B 21/00

[52] U.S. Cl. ..... 482/27; 482/77

[58] Field of Search ..... 472/134, 135, 472/95, 99, 101, 103; 482/27, 148, 142, 59, 60, 79, 80; 273/411

[56] References Cited

U.S. PATENT DOCUMENTS

| | | | |
|---|---|---|---|
| 1,456,168 | 5/1923 | Witmer et al. | 482/27 |
| 3,578,381 | 5/1971 | Young | 472/135 |
| 3,734,496 | 5/1973 | Rubin | 482/27 |
| 3,790,171 | 2/1974 | Anderson | 273/411 |
| 4,516,767 | 5/1985 | Eskijian | 482/27 |
| 4,537,396 | 8/1985 | Hooper | 482/59 |
| 4,589,656 | 5/1986 | Baldwin | 482/59 |

*Primary Examiner*—Jerome Donnelly

[57] ABSTRACT

A tire trampoline platform having a plurality of openings installed therein for purposes of blowing air from an inner cavity of the tire onto a person jumping on the platform. The plurality of vent openings having an additional template to partially or fully cover the vent openings of the platform for purposes of adjusting the resilience of the tire trampoline. A tier or multiple layers of tires are configured such that the tire trampoline apparatus can be used as a chair like apparatus. An additional capability of the tire trampoline is to have a riding toy installed thereon the platform for allowing children to play.

3 Claims, 5 Drawing Sheets

TIRE TRAMPOLINE APPARATUS

BACKGROUND OF INVENTION

1. Field of the Invention

This invention is generally related to the field of trampolines and other repetitive bouncing apparatuses used for exercise and fun. More specifically, this invention utilizes a used automotive tire inverted inside out to provide the primary resilient effect combined with a unique support platform installed thereon.

The platform has the unique feature of providing a cooling effect by blowing air from inside the cavity of the automotive tire upwards and toward the user. Most trampolines only cool the user when the user is moving through the air, but fail to provide a cooling effect when the user is at the trough of the bounce cycle. An additional feature of the tire trampoline allows the user to adjust the amount of resilience in the tire bouncing apparatus by using an adjustable vent opening.

2. Description of the Prior Art

Several approaches have been provided for bouncing an individual upwards and downwards for purposes of exercise, in Eskijian of U.S. Pat. No. 4,516,767, the abstract states, "An inflated platform, for bouncing, includes a reinforced upstanding and flexible outer side wall to resist outward expansion during bouncing, and a central upper wall at a lower level than an annular flexible top wall that merges with the central wall and side wall, the central wall overlying and spaced from a bottom flexible wall. A reinforcing layer is carried by the central wall and is centered by air pressure below the annular top wall and surrounding that layer, during bouncing; the reinforced layer and the reinforced side wall cooperating to aid platform stability during bouncing."

In the device of Gallaro, of U.S. Pat. No. 4,516,768, "An exercising device including an inflatable flexible toroidal member such as a tire tube, a substantially rigid platform disposed over and supported by the toroidal member, and foot treads positioned on the platform. The exercising device can be used not only for jogging, running, or jumping in place, but with the addition of an exercising board and an exercising stand, can also be used for sit-ups and the like."

Another approach in U.S. Pat. No. 4,836,530, Stanley teaches, "A trampoline-like aerobic exercise apparatus and method is disclosed. The exercise apparatus is designed having a raised, substantially circular base portion adapted to use a sturdy resilient fabric material as the exercise mat portion. The base portion is sized for individual, in-place exercising and is further adapted with a vertically adjustable, railed handle member means attached to said base member for balancing during exercising by a user. The exercise mat portion is mounted and forcably retained onto the base portion using a pressurized tube and rim arrangement."

While some of the prior art may contain some similarities relating to the present invention, none of them claim, teach, suggest or include all of the advantages and unique features as the invention disclosed herein.

SUMMARY OF THE INVENTION

Accordingly, it is a primary object of this invention to provide a trampoline like apparatus using an automotive tire as the primary source of resilience. An inverted automotive tire has proved to be excellent source of resilience when used in conjunction with the unique platform of the apparatus. Furthermore, the application of used automotive tires and inverting the tires for use in the apparatus decreases the number of automotive tires disposed of each year.

Another object of this invention is to provide a trampoline like apparatus having a means of providing a cooling effect to the user when he or she bounces up and down. A cooling effect is provided by openings or vents in a unique top platform unit provided at the upper inner rim of the tire. Air is sucked into the inner cavity of the tire when the tire is deflated to its normal position and shape. When the tire's inner cavity is compressed, via the weight of the person jumping downwards onto the platform, air is channeled outwards and upwards through the openings of the platform unit to cool the user.

A further object of this invention is to provide a plurality of directional vents that will channel air flow away from the user when the trampoline is used on a dirty surface. This can also be accomplished by placing a bottom cover to seal the bottom opening of the tire trampoline.

Still another object of this invention is to allow the user to adjust the tension of resilience in the tire by adjusting the size of the openings provided at the top of the platform unit. A bottom template is rotatably affixed to the bottom of the platform that can be rotated to adjust the size of the openings of the platform. The resilience of the apparatus can also be increased by placing more than one tire within one another for additional support. Typically, a smaller diameter tire can be placed inside of a larger diameter tire to increase the resiliency of the apparatus.

Still yet another object of this invention is to provide a unique means of affixing the top platform to the upper inner rim of the tire. The unique affixing means allows the platform unit to be affixed to automotive tires of varying diameters. Depending on the size of the user, larger people may require a larger tire for more resilience and stability.

Another object of this invention is to provide a automotive tire having one side wall of the tire cut in a serrated fashion and spread outwards thereby providing a stabilizing effect. Cutting the side wall of the automotive tire in a serrated fashion allows the tires to be stacked within one another for additional resilience. In addition to stabilizing and increasing the resiliency of the tire trampoline, the serrated side walls of the automotive tire allows for a plurality of tires to be stacked tightly within one another for decreasing the amount of space necessary for storage. A final advantage of serrating the side wall of the automotive tire is that an average individual can invert the tire inside out more easily without any special tools.

A further object of this invention is to provide a rigid top platform that will allow a user to mount an animal type of toy thereby allowing children to ride thereon.

Still a further object of this invention is to provide a means of giving the user stability when he or she is bouncing up and down. Typically a rope or elastic band is provided that is affixed to the tire at opposite sides whereby the user holds onto the bands for stability during exercise.

Another object of this invention is to provide a platform made of a flexible material to give additional resilience and performance to the apparatus when he or she is bouncing.

A further object of this invention is to provide a set of automotive tires stacked in a vertical fashion to provide a chair like trampoline apparatus. This will allow a user to be seated on the vertical stack while still providing the same resilience and cooling effect to the seated user.

Still yet a further object of this invention is to increase the circulatory system of the user in particular, the Lymph system. Unlike the blood system, the Lymph system circulates only by body movement like the oscillating movement during repetitive bouncing or muscle contractions. In the lymph system, plasma proteins must be continually replaced or they can block and disrupt the normal continuous exchange of nutrients throughout the cells. Proper introduction of nutrients and excretions of toxins in the lymph system surrounding the cells help to prevent degenerative diseases.

In carrying out this invention in the illustrative embodiment thereof, a tire trampoline apparatus utilizing a used or recycled automotive tire is provided that will give a user the ability to exercise in an oscillating fashion for providing health benefits. First, an automotive tire is inverted inside out whereby the inside and the outside of the tire are reversed, this increases the resiliency of the tire. Next, the user may insert the platform of the apparatus into the hole of an automotive tire. Using a system of locking tabs, the user secures the platform onto the rim of the automotive tire. The user then may adjust the size of the vent openings of the platform to vary the amount of resilience of the apparatus. For additional stability, the bottom side wall of the tire can be cut around the perimeter in a serrated fashion whereby the wall is spread outwards away from the tire's center and laid onto the ground.

In the tier configuration, or chair like configuration, more than one automotive tire is stacked upon one another and affixed together. Similarly, the platform is then secured onto the rim of the top automotive tire for a user to sit.

BRIEF DESCRIPTION OF THE DRAWINGS

This invention, together with other objects, features, aspects and advantages thereof, will be more clearly understood from the following description, considered in conjunction with the accompanying drawings.

Five sheets of drawings are furnished, sheet one contains FIG. 1, FIG. 5, and FIG. 6, sheet two contains FIG. 2 and FIG. 3, sheet three contains FIG. 4, sheet four contains FIG. 7, and sheet five contains FIG. 8.

DESCRIPTION OF THE PREFERRED EMBODIMENTS

Figure 1:
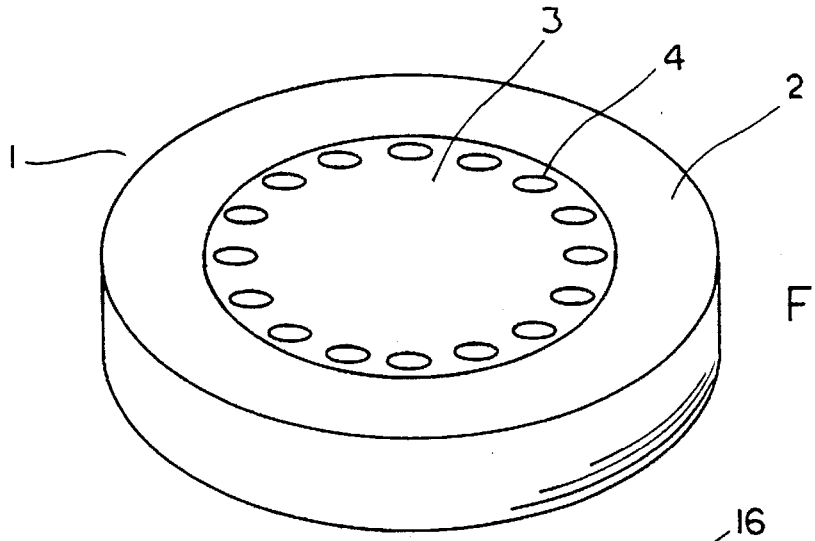
FIG. 1 is a perspective view of the tire trampoline with the top platform installed onto the top opening of the tire.

Referring now to FIG. 1, a tire trampoline apparatus referred to generally by the reference numeral 1 is made of a circular platform 3 supported by an automotive tire 2 with the circular platform 3 having a plurality of vent openings 4 installed therein.

Figure 5:
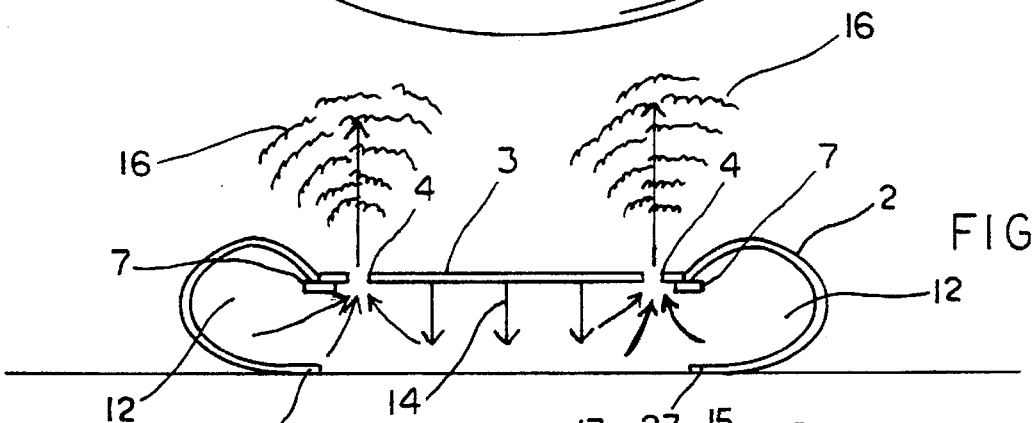
FIG. 5 shows a side view of the tire trampoline with the platform being pressed in a downward fashion.
Figure 6:
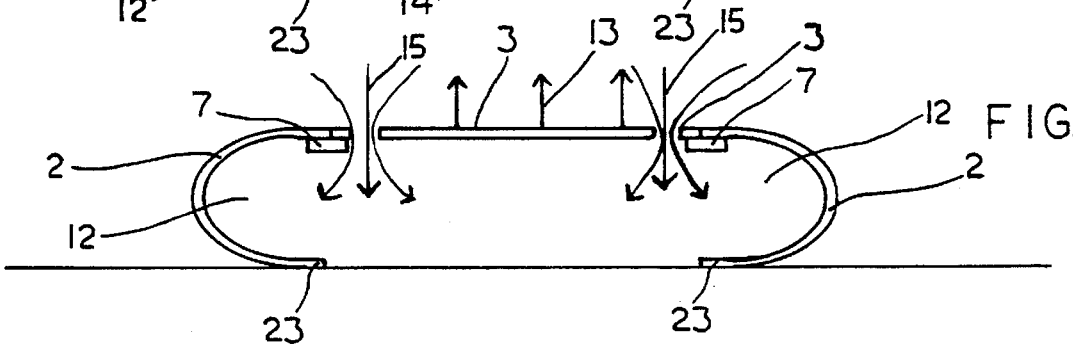
FIG. 6 shows a side view of the tire trampoline in a fully expanded position.

Referring to FIG. 5, we see a side view of the tire trampoline apparatus 1 showing the circular platform 3 being compressed in a downward fashion represented by directional arrows 14. The circular platform 3 with vent openings 4 allows a gust of air 16 to be channeled outwards and upwards towards a user jumping on the circular platform 3. The tire trampoline 1 having a hollow cavity 12 for suppling a reservoir of air to be sprayed outwards and upwards towards the person using the apparatus during exercise when the circular platform 3 is moving in a downward fashion. The hollow cavity 12 being formed by the tire 2, the circular platform 3, and a sealed perimeter 23. Similarly, in FIG. 6, we see the tire trampoline 1 when the circular platform 3 is moving in an upwards fashion represented by directional arrow 13. The cavity 12 accumulates air 15 via vent openings 4 when said circular platform 3 is moving in an upwards fashion 13.

Figure 4:
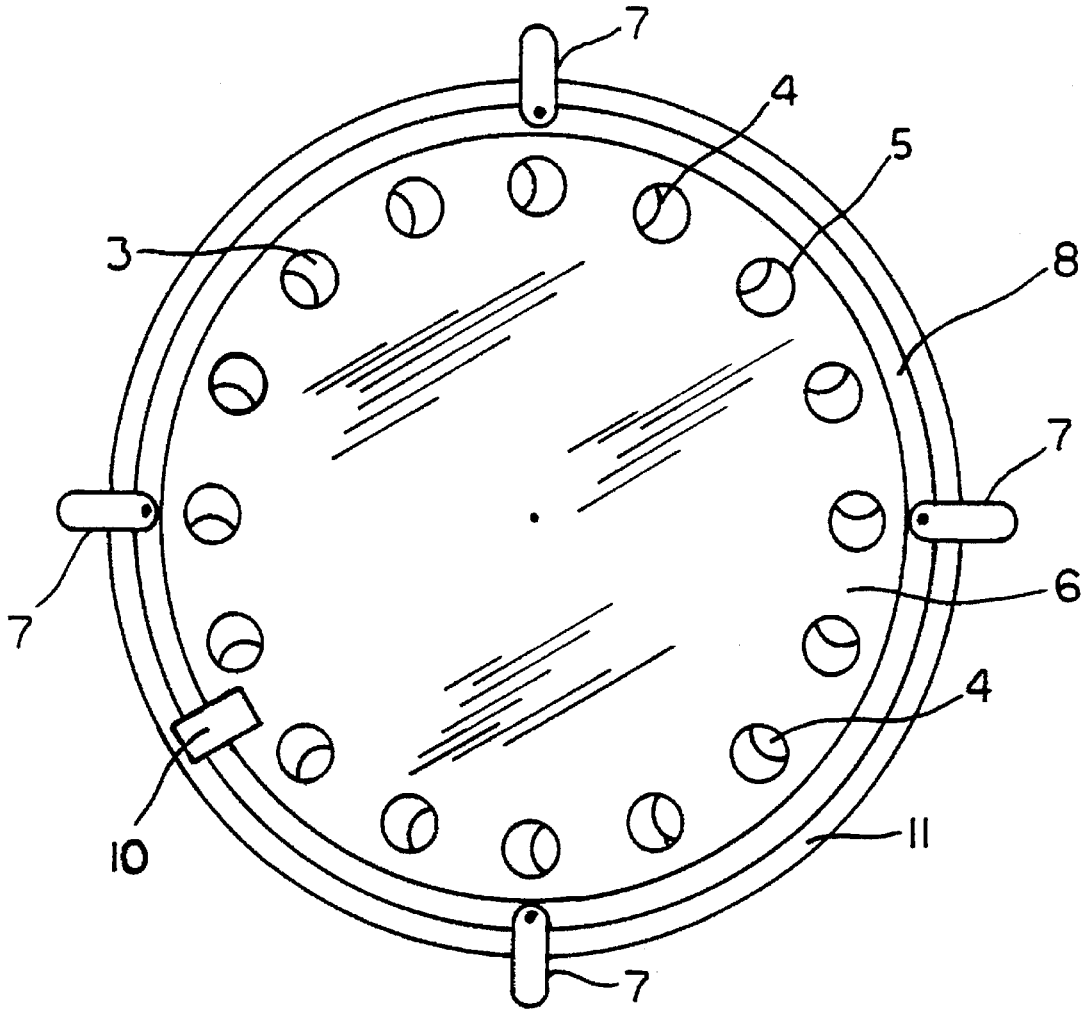

Referring now to FIG. 4, we see a bottom view of the circular platform 3 showing a bottom circular bottom template 6 rotatably affixed to circular platform 3 with the template 6 having a plurality of vent openings 5 installed therein. The vent openings 5 being equal in number and adjustably aligned with vent openings 4 of circular platform 3. The bottom of platform 3 having a flange 8 that is to be inserted into the rim opening of an automotive tire 2. Circular flange 8 further having a plurality of locking tabs 7 rotatably affixed thereto to secure the circular platform 3 onto the automotive tire 2. The bottom template 6 further having a stop 10 to restrict full rotation of the bottom template 6.

Figure 2:
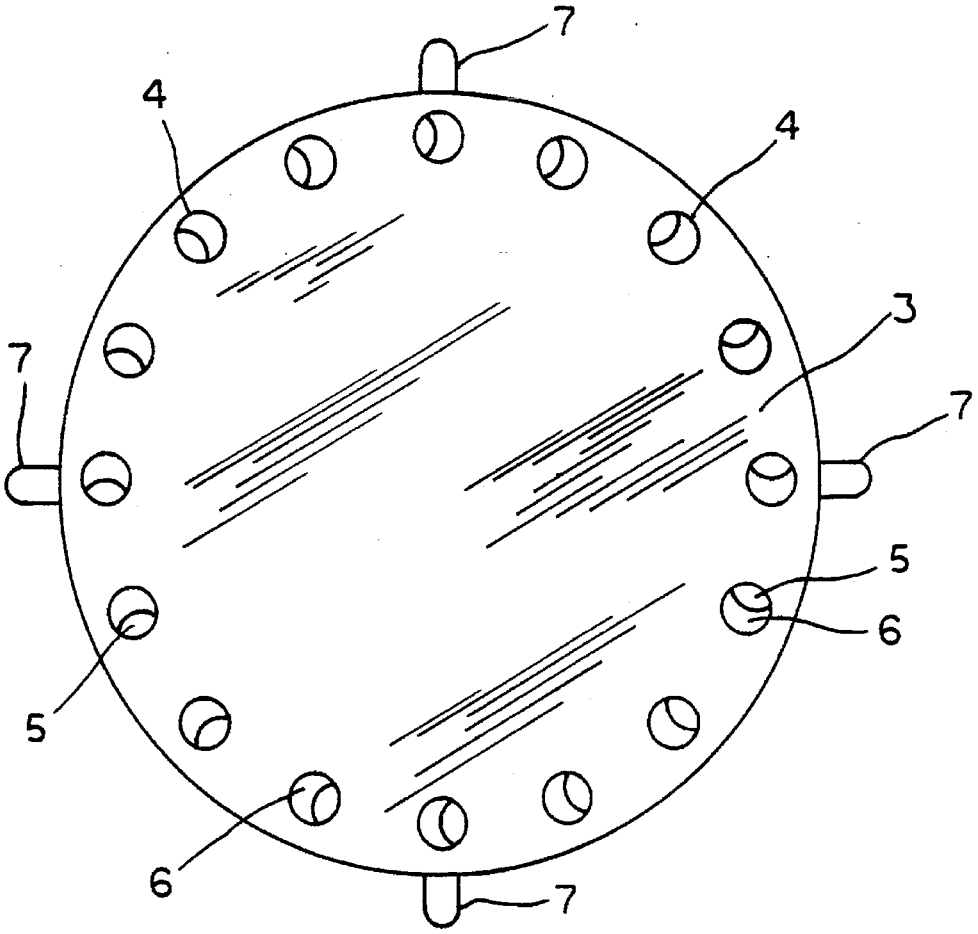
FIG. 2 shows a top view of the platform with a plurality of vent openings therein and locking tabs.

Referring now to FIG. 2, we see a top view of the circular platform 3 having a plurality of vent openings 4 installed therein. A plurality of locking tabs 7 can be seen protruding from the sides of circular platform 3 for purposes of securing said circular platform 3 onto an automotive tire 2. A circular bottom template 6 can be seen through vent openings 4 with circular bottom template 6 further having a plurality of openings 5 installed therein.

Figure 3:
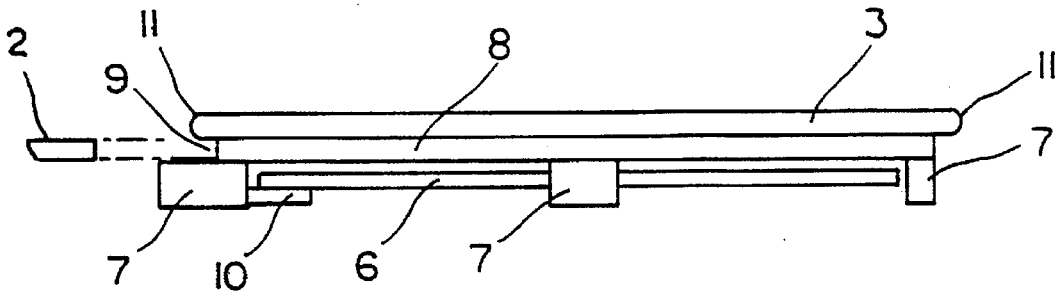
FIG. 3 shows a side view of the platform with FIG. 4 showing a bottom view of the platform.

Referring to FIG. 3, we see a side view of the circular platform 3 comprising a circular bottom template 6 rotatably affixed thereto the circular platform 3. The bottom of platform 3 having a circular flange 8 that is installed into the rim opening of an automotive tire 2. The circular flange 8 having a plurality of locking tabs 7 rotatably affixed thereto. A cavity 9 is formed by locking tabs 7 and outside periphery 11 and is used to have the edges of the automotive tire 2 installed therein.

Figure 7:
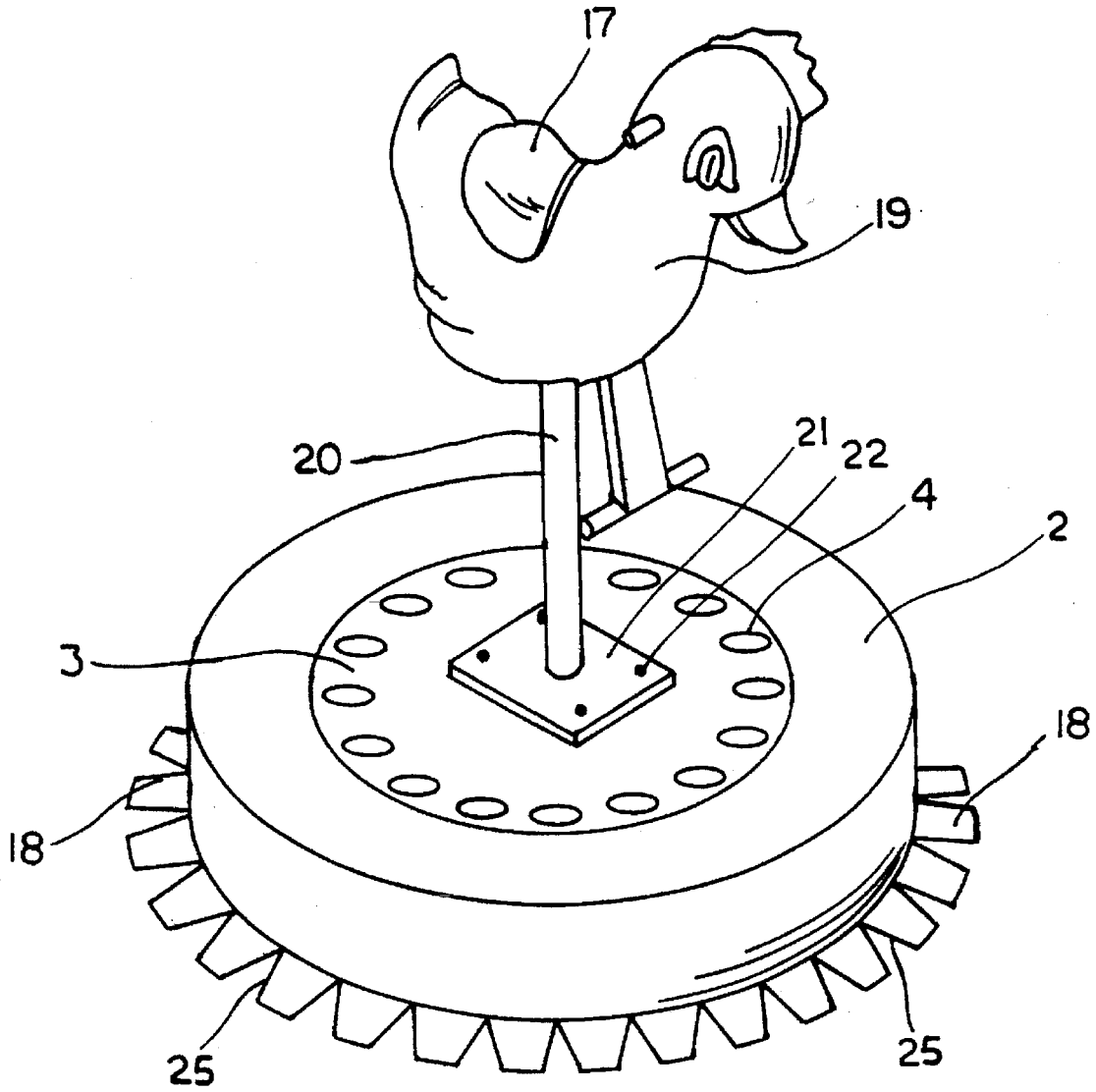
FIG. 7 displays a riding toy apparatus affixed to the top surface of the platform thus allowing additional usage of the trampoline apparatus. The bottom side wall of the automotive tire is cut a plurality of times in a serrated fashion to give additional stability to the apparatus.

Referring now to FIG. 7, we see an alternative usage for the tire trampoline 1 having a riding toy 19 installed thereon. The tire 2 having a stabilizer 18 formed from a plurality of serrated cuts 25 into the side wall of tire 2 and spread outwards from the tire's central axis. The stabilizer 18 gives additional stability to the tire trampoline 1. The riding toy 19 with a saddle 17 having a pole 20 affixed thereto at one end and a base plate 21 affixed thereto the opposite end. The base plate 21 being affixed thereto said circular platform 3 via affixing means 22.

Figure 8:
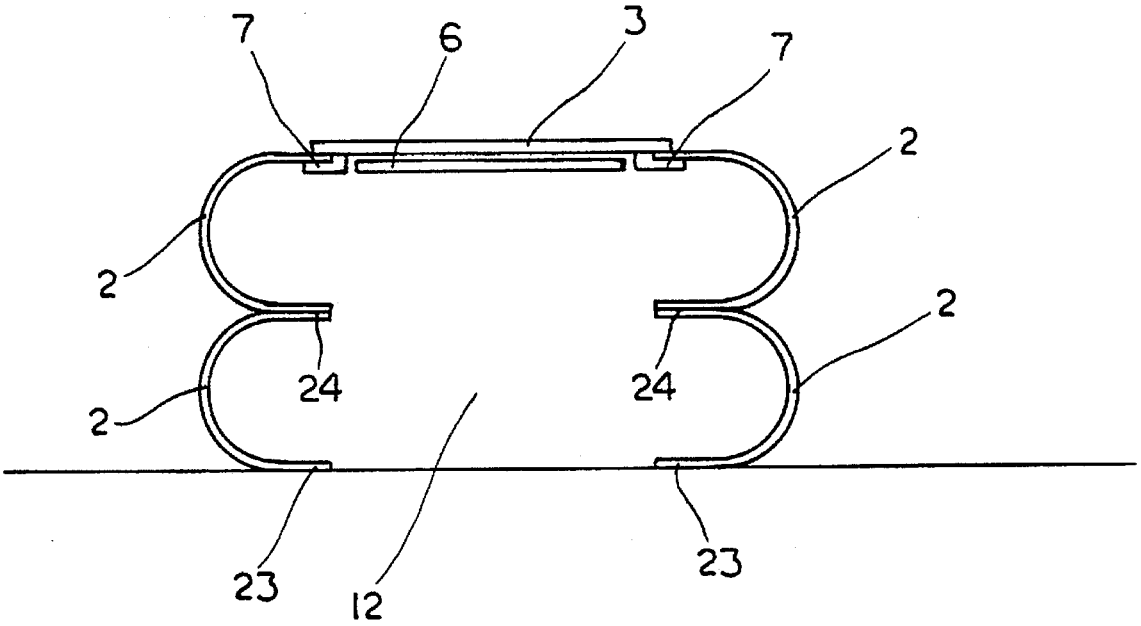
FIG. 8 displays a multiple layered approach in which the platform is secured onto the top tire whereby a user can be seated comfortably.

Referring to FIG. 8, we see a multiple layered trampoline apparatus in which more than one tire is stacked upon one another. The circular platform 3 is secured onto the top tire 2 and the top tire 2 is affixed to a bottom tire 2 at the site 24. Similarly, the bottom tire 2 forms a seal with the ground at site 23 to allow air to be compressed out of cavity 12 when a user is jumping on the apparatus.

Accordingly, a very unique, attractive, and convenient apparatus are provided for a tire trampoline apparatus.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A bouncing apparatus for use in repetitive jumping comprising:

a tire having an upper inner rim, a platform unit secured to said upper inner rim of said tire, said platform unit including;

a circular platform;

said circular platform having an outside periphery, a circular flange, positioned on a bottom surface of said circular platform, inwardly of and substantially around the periphery thereof and a plurality of locking tabs spaced along and rotatably affixed to a lower edge of said circular flange to thereby secure said platform to said tire;

a circular bottom template, rotatably affixed to a bottom surface of said platform, said template having a plurality of vent openings installed therein, said template vent openings being equal in number and variably alignable with a plurality of vent openings of said circular platform;

allowing a user to adjust the amount of air flow which may pass through the vent openings of said platform unit thereby adjusting the resiliency of said bouncing apparatus and the amount of airflow which is blown on a user when a user repetitively moves said platform unit up and down.

2. A bouncing apparatus as set forth in claim 1 wherein said tire further includes a bottom opening, said bottom opening includes a cover affixed thereon whereby dust is prevented from entering said tire.

3. A bouncing apparatus as set forth in claim 1 wherein said tire is turned inside out thereby increasing the resiliency of said tire when a user repetively jumps on said bouncing apparatus.

* * * * *